United States Patent [19]

Kajiwara et al.

[11] 4,123,011

[45] Oct. 31, 1978

[54] COIL UNWIND AND WIND-UP METHOD AND APPARATUS THEREFOR

[75] Inventors: Toshiyuki Kajiwara; Tadashi Nishino, both of Hitachi, Japan

[73] Assignee: Hitachi, Ltd., Japan

[21] Appl. No.: 839,772

[22] Filed: Oct. 6, 1977

Related U.S. Application Data

[63] Continuation of Ser. No. 657,234, Feb. 11, 1976, abandoned.

[30] Foreign Application Priority Data

| | | | |
|---|---|---|---|
| Feb. 19, 1975 | [JP] | Japan | 50-20615 |
| Apr. 25, 1975 | [JP] | Japan | 50-49629 |
| Jul. 2, 1975 | [JP] | Japan | 50-80803 |

[51] Int. Cl.[2] ..... B21C 47/02; B21C 47/16; B21C 47/24

[52] U.S. Cl. ..... 242/78.1; 242/78.6; 242/79

[58] Field of Search ..... 242/78, 78.1, 78.3, 242/78.6, 78.7, 78.8, 79, 58.6, 58

[56] References Cited

U.S. PATENT DOCUMENTS

| | | | |
|---|---|---|---|
| 2,257,743 | 10/1941 | Greer | 242/78.1 |
| 2,267,036 | 12/1941 | McArthur | 242/79 X |
| 2,687,878 | 8/1954 | Montgomery | 242/78.3 |
| 3,132,820 | 5/1964 | Toll | 242/78.6 X |
| 3,365,144 | 1/1968 | Daub | 242/78.1 |
| 3,489,364 | 1/1970 | Kajiwara | 242/78.1 |
| 3,593,938 | 7/1971 | Watt | 242/78.1 X |
| 3,679,150 | 7/1972 | Fever | 242/78.1 |

*Primary Examiner*—Peter Feldman
*Assistant Examiner*—John M. Jillions
*Attorney, Agent, or Firm*—Craig & Antonelli

[57] ABSTRACT

A coil unwind method wherein a large coil is formed by successively jointing a plurality of coils unwound from an unwind machine for unwinding transportable coils, and thereafter a strip is unwound from said large coil to be supplied to a processing equipment.

8 Claims, 9 Drawing Figures

COIL UNWIND AND WIND-UP METHOD AND APPARATUS THEREFOR

This is a continuation of application Ser. No. 657,234, filed Feb. 11, 1976, now abandoned.

This invention relates to a coil unwind and wind-up method and an apparatus therefor, particularly, is concerned with a coil unwind and wind-up method and an apparatus therefor, by which a continuous operation for a prolonged period of time is attainable.

In order to increase production in a cold tandem mill, a continuous plating apparatus or the like, it is necessary first of all to reduce the time which might otherwise be wasted during the threading operation. One method to solve this problem is to increase the weight per coil to thereby reduce the ratio of the threading time to the rolling time. In this case, however, if the weight of coil is not increased considerably, the effect will remain low. If, contrarily, the weight of coil is increased, the transportation of coils will become difficult, and moreover there will be a need to provide the wind-up machine or unwind machine with an extra rigidity, thus causing said method to be unsuitable for practical application.

Under such circumstances, recently there has been a study made on a fully continuous equipment, and there is a tendency to weld the rear end of the preceding coil to the forward end of the succeeding coil during the rolling or plating, to thereby eliminate the threading operation. Because the rolling or plating is interrupted during said welding, the operation will be hindering and the quality of product will be affected. Therefore, the improved apparatus of the prior art has been constructed such that, in the case of unwinding, a strip is previously accumulated in a looper, released at the time of coil insertion and welding, and then continuously passes through the rolling mill or the plating device. Said apparatus has greatly contributed to increased production and improved yield.

However, there have been found the following drawbacks even with this improved apparatus, and from time to time necessity has been voiced for a radical improvement.

(a) In order to secure the sufficient unwind quantity at the time of coil change and during the welding, a long looper and a large installation area are required. This leads to increased costs and thus a limit is placed upon the conditions of geographical location. For example, an accululated strip quantity of 300 to 500 m is necessary for a cold running equipment. Even if the number of strips is quadrupled, a stroke of a loop car of 75 to 100 m is necessary, thus requiring facilities therefor ranging from 100 to 125 m in length.

(b) Since a strip running within a looper tends to meander in the use of a looper, careful attention must be paid to preventing the meanders of the looper. Particularly, when an anti-corrosion oil is applied to the strip, the strip tends to meander. However, when the anti-corrosion oil is not applied, there is a possibility of rusting. Therefore, immediate rolling or plating is required in this case.

(c) Weld spots of the strip should be detected prior to the rolling because the rolling speed should be decreased at the weld spots in the use of a rolling equipment. However, the position of the looper is constantly changed and hence a complex detecting mechanism is required for predicting entry of the welding spots.

(d) Such a condition is presented that the strip is constantly intervened in the rolling mill, resulting in complicated roll rearranging operation.

On the other hand, the strips successively released are wound up at the outlet side of the processing equipment, and in order to transfer the strip to the following process, the strip should be shorn in such a manner that the strip has an ordinary coil diameter, and thereafter is wound up. In the case of shearing, shearing cannot be effected unless the operation of the shear cutter and the speed of the strip are maintained in synchronism, thus placing a limit on the speed of the strip. For this, it becomes necessary to interrupt or decelerate the movement of the strip, thereby affecting the quality of plated articles and moreover hindering the improvement in productivity.

For the foregoing reasons, there has been such a practice that a looper is also provided at the outlet side of the processing equipment, and the strip is accumulated in said looper at the time of shearing and at the initial stage of wind-up, thereby allowing the strip to pass through the processing equipment successively. Such methods as described above have been adopted in continuous galvanizing equipment with a high effect accomplished. Additionally, such a method is adopted in the continuous tandem mill that temporarily the rolling speed is decreased to the shearing speed of the running shear disposed at the outlet side of the rolling mill, and after the shearing the rolling speed is accelerated to perform continuous rolling so that the apparatus according to said method greatly contributed to increased production and improved yield.

However, even with such an excellent apparatus, there have been seen the drawbacks similar to the aforesaid unwind machine when a looper is used. Furthermore, such an operation should be performed each time a coil is supplied that the speed of the processing equipment has to be decreased to the shearing speed and the speed of the processing equipment has to be increased after the shearing. This operation causes successive troubles, and further a limit is placed upon the improvement in productivity by said decelerating process.

In view of the above circumstances, this invention is devised, and the object thereof is to provide a coil unwind and wind-up method and an apparatus therefor, in which the drawbacks of the prior art are eliminated, the operation is made easier and the production efficiency is considerably enhanced.

Firstly, the feature of the coil unwind method according to the present invention resides in that the coil to be carried in is of an ordinary weight, a plurality of coils are wound up into a single coil. and thereafter a strip is unwound from said new coil to the processing equipment. Secondly, the feature of another invention according to the present invention resides in that at least two drums forming secondary coils are provided, and the time required for changing secondary coils can be reduced by alternately using said respective drums for wind-up or unwind purpose, thereby causing the apparatus to carry out more effective coil unwind operation and the like.

Additionally, the feature of the coil wind-up method according to the present invention resides in that the strip having been successively processed is wound up into a coil of a large diameter, and thereafter said coil is shorn into coils having an ordinary coil diameter and wound up again as ordinary coils. Another invention according to the present invention is characterized in that at least two drums for winding up the strip released from the processing equipment are provided, the time which might otherwise be wasted can be reduced by alternately using said respective drums for wind-up or unwind purpose, thereby allowing the apparatus to carry out more effective coil wind-up operation.

In general, enlargement of the width of coil requires an enlarged transportation means, and further creates a possibility of toppling of the coil in the case of transportation being made by a conveyor or a coil car, if the outer diameter of the coil becomes unproportionally larger than the width of the plate. Therefore, the diameter of coil itself tends to be limited by this condition, and in general, the outer diameter of coil is limited to approx. 3 to 3.5 times the plate width. In contrast with this, although the coil carried in has a size and weight of an ordinary coil, it is possible to make the size and weight of coil to be about 10 times the original size and weight. Thus, the number of threading operations can be reduced to one tenth of the number of operations of the prior art, thereby enhancing the production capacity. In addition, this is true with the coil when carried out after the processing.

Figure 1:
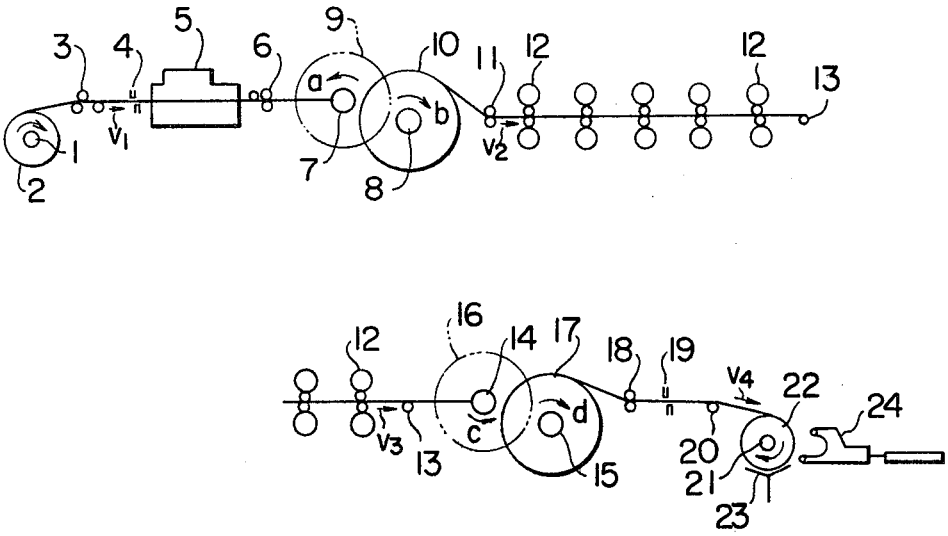
FIG. 1 is a side view showing the general layout of the equipment as applied to a cold tandem mill.
Figure 4:
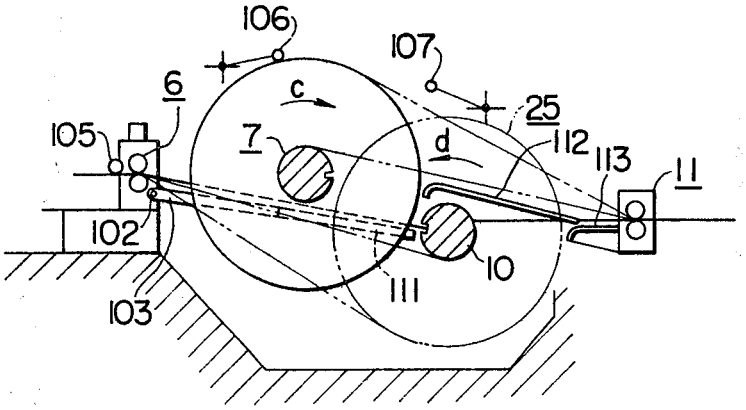
FIG. 4 is a side view showing the intermediate wind-up and unwind operations at the inlet side.
Figure 2:
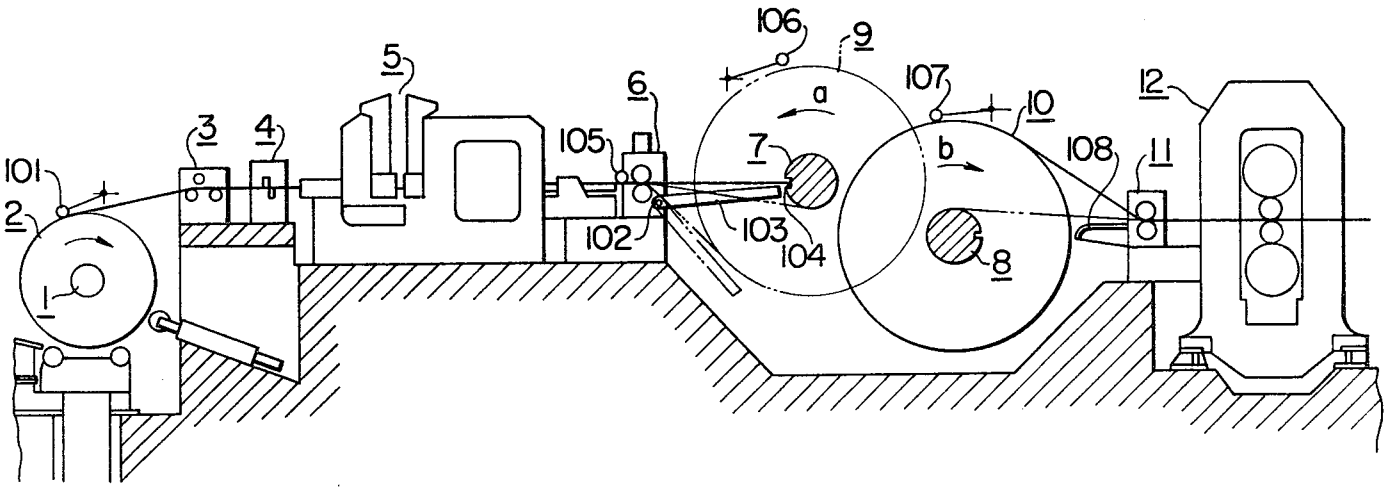
FIG. 2 is a side view showing the inlet side equipment.
Figure 3:
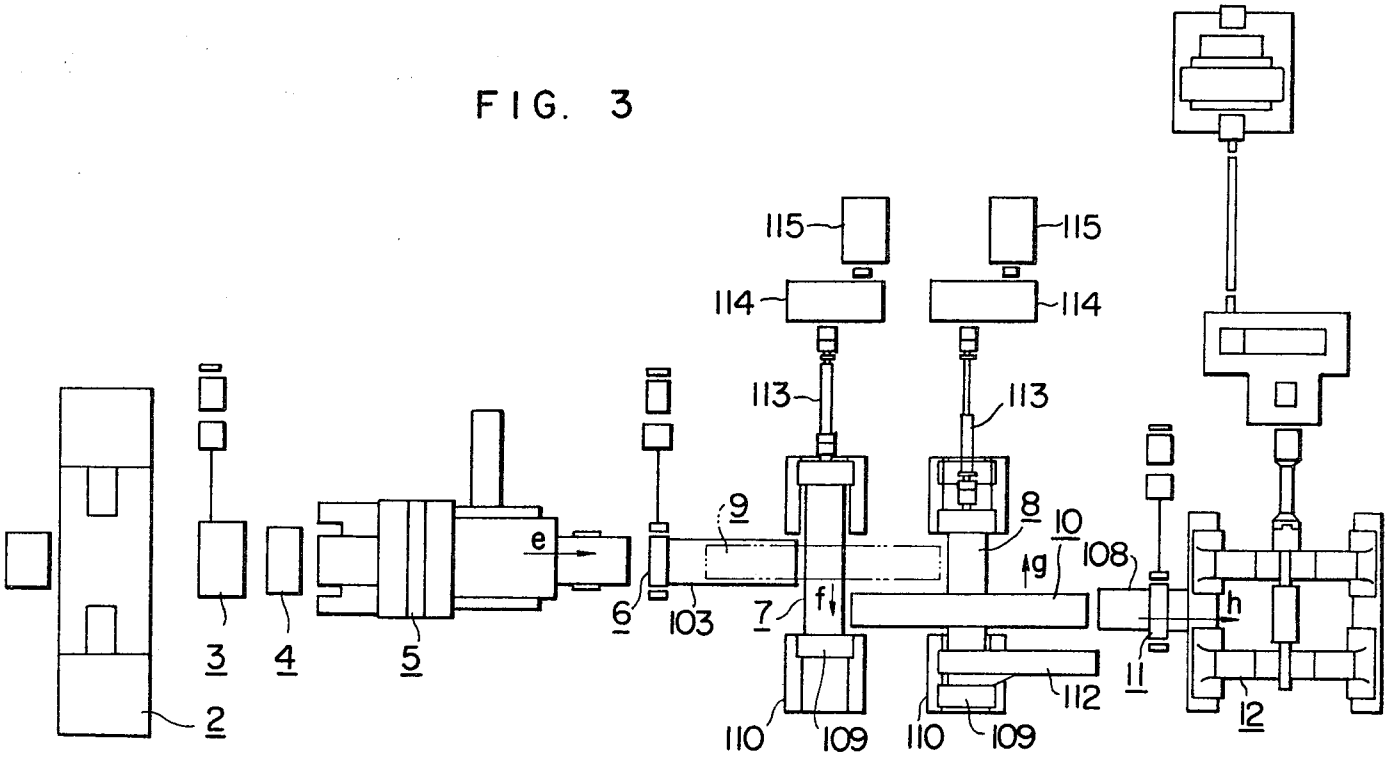
FIG. 3 is a plan view of the above.
Figure 5:
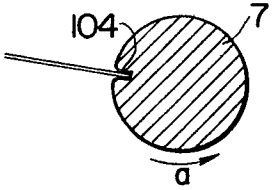
FIG. 5 is a cross-sectional view of the intermediate wind-up drum.

Description will hereunder be given of the embodiment according to the present invention with reference to the drawings. FIG. 1 is a view of the embodiment of the general schematic layout according to the present invention, in which there are shown the inlet side equipment including a welding machine and an intermediate wind-up machine at the inlet side, and the outlet side equipment including a rolling mill, an intermediate wind-up machine at the outlet side and a shear. Designated at 1 is an unwind machine, 4 a shear, 5 a welding machine, 7 and 8 intermediate wind-up machines at the inlet side, 12 a rolling mill, 14 and 15 intermediate wind-up machines at the outlet side, 19 a shear, and 21 a wind-up machine.

The primary coil 2 carried into the wind-up machine 1 is straightened out at the forward end thereof by a feeder 3 at the inlet side or the rolling mill. The wind-up operation is started by the intermediate wind-up machine 7 at the inlet side. First, when the rear end of the primary coil approaches the shear 4, the intermediate wind-up operation is interrupted, and the coil is cut off at the rear end thereof so that welding may be easily carried out. Further, the succeeding primary coil is cut off at the forward end thereof in the same manner as above and the preceding coil and the succeeding coil are welded and jointed by the welding machine 5, and the wind-up operation is continued. About ten primary coils are jointed in this manner and the forming of the secondary coil 9 is completed. Meanwhile, the rolling of the secondary coil 10 is under way, and as soon as the rolling of the secondary coil 10 is completed, the rolling of the secondary coil 9 is started. The inlet side intermediate wind-up drums 7 and 8 are alternately used for wind-up and unwind purpose in the manner described above, so that the strip can be supplied to the rolling mill in a nearly continuous condition. On the other hand, the threading of the secondary coil 10 is made through the medium of a deflector roller 11 at the outlet side of the rolling mill, and as soon as the wind-up operation is started by the outlet side intermediate wind-up drum 14, the rolling mill 12 effects draft and the rolling is started. In this case, the outlet side intermediate wind-up drum 14 is capable of winding up a strip into a coil of a large diameter, i.e., a tertiary coil 16 so that the secondary coil 10 can be rolled and wound up without the deceleration. The tertiary coil 17 having been wound up in this manner is unwound again, shorn to form coils of an ordinary diameter, i.e., quaternary coils 22 by means of a shear 19, wound up by the wind-up machine 21, and carried out to the succeeding process by a coil car 23 and a conveyor. It will be noted that the strip can be continuously wound up also on the outlet side so that the rolling in units of large diameter coils can be carried out without the acceleration or deceleration.

Description will hereunder be given of the equipment and the operation in detail with reference to the drawings. Firstly, the inlet side equipment is described with reference to FIGS. 2 through 5. The primary coil 2 carried on the wind-up machine 1 is subjected to a leading of a strip by a snubber roller 101 and then the forward end of the strip is straightened out by a feeder 3. The forward end of the strip is guided by a pinch roller 6 and a threading guide 103 which is oscillatingly movable about a fulcrum 102, inserted into a slit groove 104 provided in the intermediate wind-up drum 7, and the wind-up operation is started in the arrow-marked direction. The speed of the threading and of the first wind-up is as low as approx. 40 m/min, and the speed of further wind-up is increased to $v_1$ after several turns when the strip is subjected to tension. A method in which the coil is wound up by a drum with a slit groove was shown in this embodiment. However, in order to wind up more reliably, it is possible to provide a grip means for securing the forward end of the strip, or wind up by means of a belt wrapper.

Now, immediately before the completion of the rewind-up of the first primary coil, i.e., at the position where the rear end of the strip approaches the shear 4, the movement of the welding line is interrupted, the rear end of the strip is cutt off so that the following step of welding joint can be made in an optimum state, and the strip is delivered to the welding machine 5. On the other hand, the succeeding primary coil is unwound in the manner described above, the forward end of the strip is shorn by the shear 4, delivered to the welding machine 5, and the rear end of the preceding coil and the forward end of the succeeding coil is welded and jointed. Thereafter, the intermediate wind-up is started again. The primary coils are successively jointed to each other in the welding line in the manner described above, thereby forming a secondary coil.

The secondary coil 10 is being rolled in the rolling line while the forming of the secondary coil 9 is under way. When the secondary coil 10 is continuously unwound and the rolling thereof is close to the completion, the roll 10 becomes thin, and hence the secondary coil 10 of which the forming has already completed can be previously moved together with an intermediate wind-up drum 7 and a bearing 109 along a bearing guide 110 to the rolling line in the direction indicated by an arrow *f* by means of a hydraulic cylinder (not shown) or the like. Therefore as soon as the rolling of the coil 10 is completed, the unwinding of the next coil 10 can be started to conduct threading and rolling of a strip thereof. Additionally, the intermediate wind-up drum 8 having finished the unwinding is moved for forming the next secondary coil 9 to the welding line in the direction indicated by an arrow *g*, and starts the wind-up operation again in a state shown in FIG. 4. The threading is carried out by means of a threading guide 111 incorporated in a threading guide 103 and linearly movable therefrom.

The secondary coil 9 having been moved to the rolling line receives an operation of a snubber roller 106 and the strip is guided by a guide plate 112 solidly secured to the bearing 109 and a fixed guide 108, and delivered to the rolling mill 12 through a pinch roll 11. When the diameter of the secondary coil is as small as about six ordinary coils, difficulties can be avoided in such a way that the guiding and unwinding of the strip is made easier by making the guide plate 112 to be extensible in the direction of the line. Additionally, the unwinding of the secondary coil can be smoothly carried out by conversely bending the rear end of the strip by means of a strip rear end bending roller mounted vertically movably on a pinch roll 6 within the welding line.

The intermediate wind-up machines 7 and 8 are driven by electric motors 115 through telescopic shaft couplings 113 and speed reducers 114. As described above a secondary coil corresponding to 10 ordinary coils in size can be successively rolled, thus obtaining a considerably increased productivity.

Figure 6:
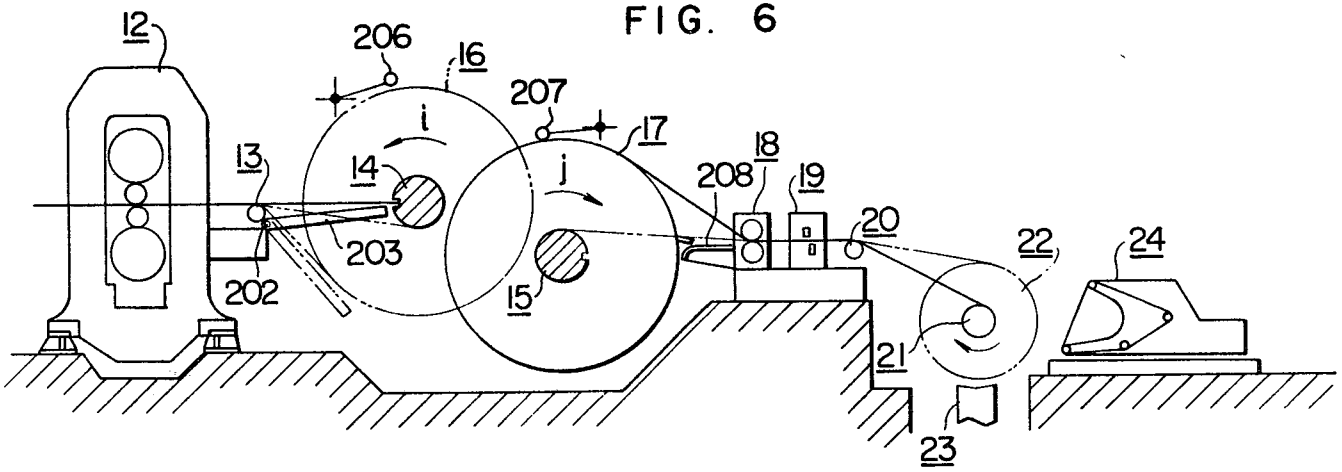
FIG. 6 is a side view showing the outlet side equipment.
Figure 7:
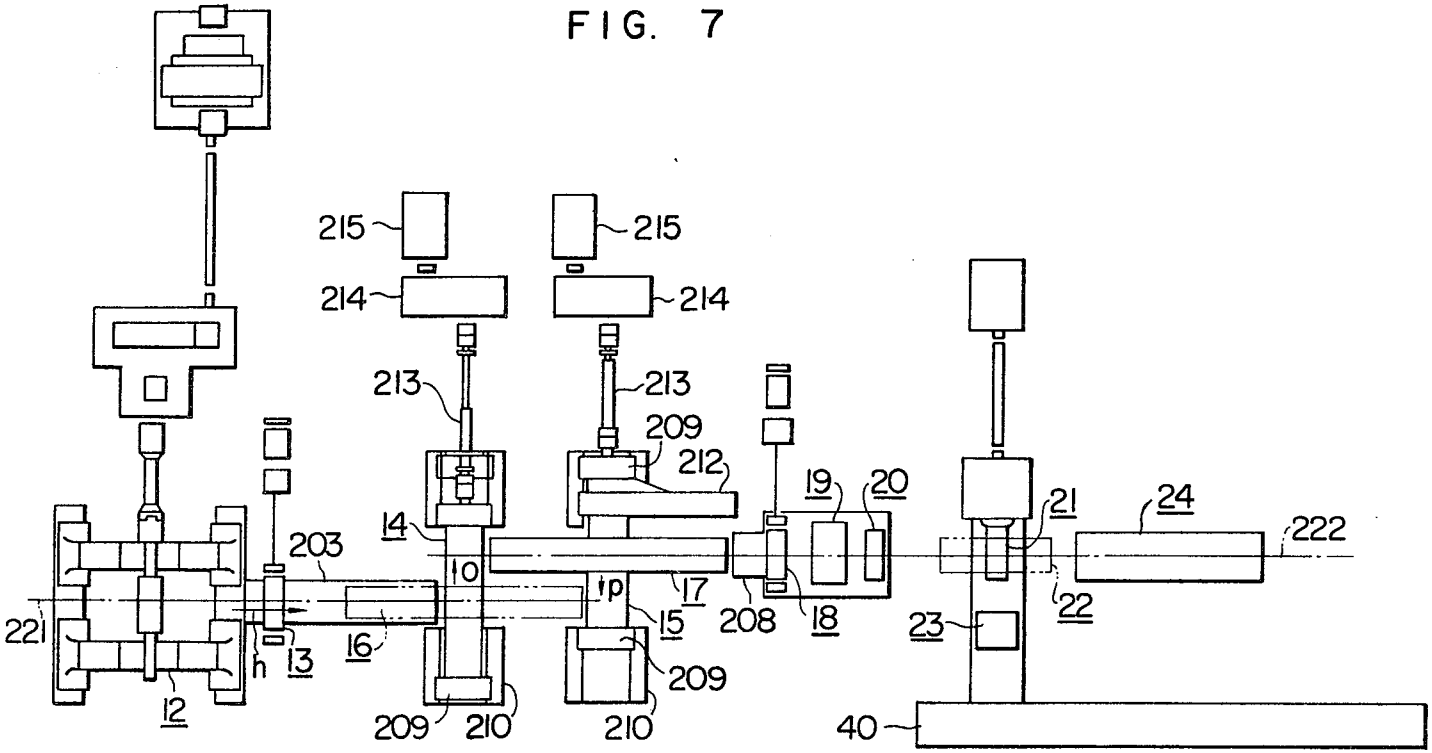
FIG. 7 is a plan view of the above.

Next, detailed description will be given of the wind-up operation at the outlet side with reference to FIGS. 6 and 8.

The tertiary coil 17 having completed the wind-up of the rolled strip is moved together with the outlet side intermediate wind-up drum 15 from the rolling line 221 to a shearing and wind-up line 222. The strip of the coil is introduced to a fixed guide 208 through a snubber roller 207. The strip is then passed through a pinch roll 18 and guided along a deflector roller 20 onto the wind-up drum 21, which starts the wind-up of the strip by the aid of a belt wrapper 24. The wind-up operation is interrupted when the diameter of coil becomes equal to about that of an ordinary coil, i.e., a quaternary coil 22, and the strip is shorn by the shear 19. When the wind-up operation is completed, the coil is carried out by the coil car 23. Thereafter, the remaining part of the tertiary coil 17 is wound up in like manner, and quaternary coils are successively formed and carried out.

Meanwhile, the strips successively released are wound up by the outlet side intermediate wind-up machine 14 in the rolling line 221, thereby forming the tertiary coil 16. As soon as the unwind operation of the tertiary coil 17 is completed, the tertiary coil 16 is moved together with the outlet side intermediate wind-up drum 14 and a bearing 209 along a bearing guide 210 to a shearing and wind-up line 222 in the direction indicated by an arrow *o* by means of a hydraulic cylinder (not shown) or the like, and unwound in the same manner as the unwinding or the aforesaid tertiary coil 17. However, prior to the operation described above, the outlet side intermediate wind-up drum 15 is also moved for the start of wind-up operation of the succeeding strip having been rolled to a rolling line 221 in the direction indicated by an arrow *p*, and the wind-up operation is started in a state shown in FIG. 8. In this case, the threading from the deflector roller 13 to the outlet side intermediate wind-up drum is made by the aid of a telescopical guide incorporated in a threading guide 203 which is oscillatingly movabable about a fulcrum 202.

Figure 8:
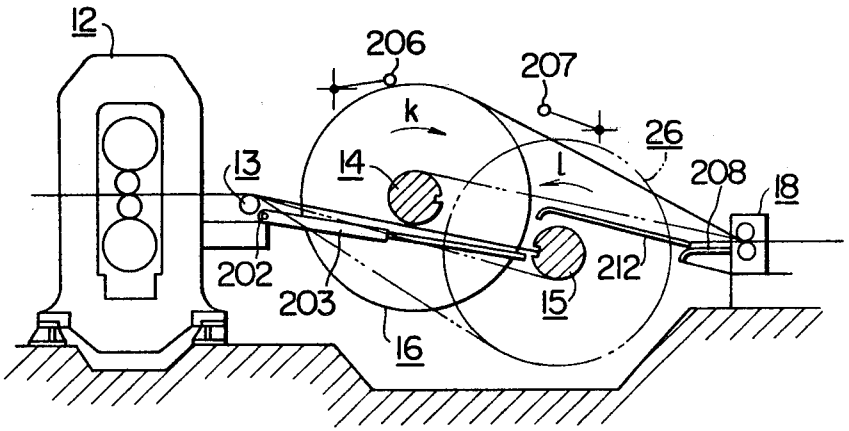
FIG. 8 is a side view showing the intermediate wind-up and unwind operations at the outlet side.

As shown in FIG. 8, in the beginning of unwinding of the tertiary coil 17 the strip thereof is subjected to an operation of a snubber roller 26 and guided by a guide plate 212 solidly secured to a bearing 209 and a fixed guide 208. When the tertiary coil has a diameter corresponding to about five ordinary coils in size, difficulties can be avoided in such a way that the guiding and unwinding of the strip is made easier by making a guide plate 212 to be extensible.

The outlet side intermediate wind-up drums 14 and 15 are driven to wind up or unwind a strip by electric motors 215 through telescopic shaft couplings 213 and speed reducers 214.

As has been described above, it becomes possible that a secondary coil corresponding to 10 ordinary coils in size can be successively rolled and successively wound up so that a considerably increased productivitity can be attained.

With this embodiment, a secondary coil of a large diameter is formed at the inlet side of the rolling mill. While said coil is being subjected to rolling, another inlet side intermediate wind-up machine is caused to form another secondary coil of a large diameter so that strips can be supplied to the rolling mill at a nearly continuous condition by alternately using the above secondary coils. At the same time a tertiary coil of the same diameter as the secondary coil is wound up at the outlet side of the rolling mill as well, while another tertiary coil having been formed is subjected to a shearing operation to form ordinary coils and the rolling can be effected in a nearly continuous condition, thereby enhancing the production efficiency to a considerable extent. In addition, since the looper is not used, not only the installation area becomes small but also the control is simplified and the operation is easy. Furthermore, the strip surface flaw detecting inspection which has conventionally been conducted in other line can be conducted in the vicinity of the wind-up machine 21, which allows the discovery of flaws at an early stage and the elimination of a danger of producing defective articles in large quantities. Furthermore, since the coil to be rolled is completely separated from the quaternary coil, even if a minor trouble would take place, it can be handled in units of 10 ordinary coils, so that the rolling can be constantly effected at the maximum capacity as compared with the looper method.

Such a method is described in this embodiment in which large coils are formed at both inlet and outlet sides of the rolling mill and the continuous rolling in units of these large coils is effected. However, another method is also applicable in which a looper is applied at either inlet or outlet side of the rolling mill and coils of a large diameter according to the present invention may be formed at the other side.

Additionally, the start of the tertiary coil wind-up was described by use of a drum with a slit groove. However, the description may be made by use of a belt wrapper.

Figure 9:
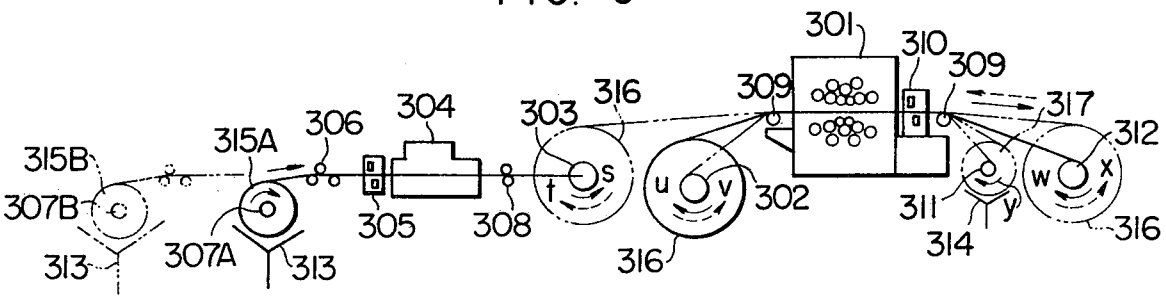
FIG. 9 is a side view showing the general layout of the equipment as applied to the reversible rolling mill.

Each of the embodiments described above was applied to the equipment in which the strip is moved in only one direction for the processing. However, the present invention is also applicable to a reversible processing equipment. Such an embodiment will hereunder be described with reference to FIG. 9.

In the drawing, generally designated at the numeral 301 is a Sendzimir rolling mill known in the art. A first wind-up and unwind machine 302 having a solid block type reel (that is, the diameter thereof is not variable) and a wind-up and unwind machine 303 for forming a large coil which has a solid block type reel similarly to above are disposed at the inlet side of said Sendzimir rolling mill 301, and further a shear 305, a three-roll feeder 306 and an unwind machine 307A having a collapsible reel (that is, the diameter thereof is variable) are disposed in front of (to the left in the drawing) the wind-up and unwind machine 303 for forming a large coil. The numeral 308 indicates a pinch roll and 309 a deflector roll.

On the other hand, a shear 310, a wind-up machine 311 and a second wind-up and unwind machine 312 are provided at the outlet side of the rolling mill 301. Said second wind-up and unwind machine 312 has a solid block type reel similarly and hence the diameter thereof is not variable. However, the reel of the wind-up machine 311 is collapsible similarly to the reel of the unwind machine 307A and hence is variable in the diameter thereof.

As described above, the first and second wind-up and unwind machines 302, 312 and the wind-up and unwind machine 303 for forming a large coil respectively have solid block type reels, and those reels are connected to a driving electric motor higher in output than the driving electric motor for the unwind machine 307A and the wind-up machine 311. A coil carry-in means 313 known in the art such as a coil car and a coil carry-out means 314 are provided in the vicinity of the wind-up machine 311 and the unwind machine 307A, respectively.

In general, two or more unwind machines 307A is preferably provided, and two or more wind-up machines 311 may be provided similarly (In the drawing, one more unwind machine 307A and a coil carry-in means 313 related therewith are indicated by two-dot chain lines).

Next, description will be given of the operation in the reversible rolling equipment of construction described above.

Prior to the rolling, strip coils 315A, 315B of a relatively small diameter which are used ordinarily are charged into the respective unwind machine 307A, 307B, and thereafter the leading of a coil 315A is performed which is charged in the unwind machine 307A disposed closest to the three-roll feeder 306. After the leading of the coil 315A is effected in said unwind machine 307A, said unwind machine 307A is driven at a low speed, and the forward end of the strip unwound from the coil 315A is inserted into and secured to the reel of the wind-up and unwind machine 303 for forming a large coil through the pinch roll 308. After the forward end of the strip unwound from the first coil is secured to the reel of the wind-up and unwind machine 303 for forming a large coil in this manner, the rotation of the unwind machine 307A is interrupted, thereafter the unwind machine 307A and the wind-up and unwind machine 303 for forming a large coil are rotated in the directions opposite with each other (In this case, the wind-up and unwind machine 303 for forming a large coil is rotated in the direction indicated by an arrow *s*.), and the coil 315A charged in the unwind machine 307A is wound up by the wind-up and unwind machine 303 for forming a large coil. In this case, the reel of the unwind machine 307A and the reel of the wind-up and unwind machine 303 for forming a large coil are controlled in speed by a control means (not shown) so that both reels have the equal circumferential speeds. When all of the coil charged in the unwind machine 307A is completely unwound and the rear end of the coil entered the shear 305, the operation of the wind-up and unwind machine 303 for forming a large coil is interrupted, and the rear end of the coil is shorn by the shear 305 and formed to be perpendicular to the side line of the strip. Thereafter, the wind-up and unwind machine 303 for forming a large coil is rotated through a predetermined angle in the direction indicated by the arrow *s*, and when the rear end of the coil reaches beneath the torch of the welding machine 304, the rotation is interrupted. Prior to this operation, the leading of the coil 315B is performed which is charged in another unwind machine 307B (indicated by two-dot chain lines in the drawing), the forward end of the coil led out of the coil 315B is inserted through the three-roll feeder 306 into the shear 305 where the forward end of the coil is cut off by a predetermined length by means of the shear 305. After being cut off at the forward end, a new forward end of the succeeding coil 315B is charged into the welding machine 304, and is jointed by welding to the rear end of the preceding coil having been stopped there.

The succeeding coil 315B thus jointed to the rear end of the preceding coil is wound up again by the wind-up and unwind machine 303 for forming a large coil which is started and rotated in the direction indicated by the arrow *s*. Meanwhile, a still other coil is carried in by a coil carry-in means 313 and charged into the vacant unwind machine 307A from which the coil 315A has been unwound.

After the operation described above is repeatedly performed, a large coil 316 formed by jointing several or ten-odd strip coils is mounted on the reel of the wind-up and unwind machine 303 for forming a large coil. After the large coil 316 is formed on the wind-up and unwind machine 303, the wind-up and unwind machine 303 is rotated in the direction indicated by an arrow *t* this time, the leading of the large coil 316 is performed, and thereafter the threading of the coil 316 is effected into the reversible rolling mill 301 which has been started at low speed. After the forward end of the coil 316 passed through the rolling mill 301 and is inserted into and secured to the reel of the second wind-up and unwind machine 312, the rotations of the wind-up and unwind machine 303 for forming a large coil, the wind-up and unwind machine 312 and the rolling mill 301 are accelerated. Needless to say that the wind-up and unwind machine 303 for forming a large coil and the wind-up and unwind machine 312 provided at the outlet side of the rolling mill 301 are rotated in synchronism in this case.

When nearly all of the strip is unwound from the reel of the wind-up and unwind machine 303 for forming a large coil, the rotations of the rolling mill 301, the wind-up and unwind machine 303 for forming a large coil and the wind-up and unwind machine 312 at the outlet side of the rolling mill are all decelerated, thereafter the rotations are made at the threading speed, and the strip remaining in the reel of the wind-up and unwind machine 303 passes through the rolling mill 301 at the threading speed. After all of the strip is unwound from the wind-up and unwind machine 303 for forming a large coil in this manner, the operations of the rolling mill 301 and the wind-up and unwind machines 303, 312 are interrupted, and the rear end of the coil strip is stopped at the inlet side of the rolling mill. From this condition, the rolling mill 301 and the wind-up and unwind machine 312 are reversely rotated at low speed, and the rear end of the strip having been stopped at the inlet side of the rolling mill is led to the reel of the wind-up and unwind machine 302 disposed at the inlet side of the rolling mill. Then, the rotations of the rolling mill 301 and the wind-up and unwind machine 312 is interrupted, and after the rear end of the strip is secured to the reel of the wind-up and unwind machine 302, the reverse rolling after a second pass is commenced. In other words, after the end portion of the strip is secured to the reel of the wind-up and unwind machine 302, the rotations of the wind-up and unwind machines 302, 312 and the rolling mill 301 are accelerated, the strip wound up on the wind-up and unwind machine 312 is unwound in the solid line direction indicated by an arrow in the drawing by the rotations of the wind-up and unwind machines 302 and 312 in the directions of *v* and *x*, respectively, rolled in the rolling mill 301, and wound up by the wind-up and unwind machine 302.

A predetermined number of rolling passes for strips are commenced by alternately effecting the wind-up and unwind operations between the wind-up and unwind machines 302 and 312 in the manner described above, at the same time, the wind-up operation for the coil strip unwound from the unwind machine 307A is commenced in the vacant wind-up and unwind machine 303 for forming the succeeding large coil (Description has been given of the large coil forming operation in the wind-up and unwind machine 303 for forming a large coil, and therefore description thereof is omitted.)

It is necessary to unwind all of the strip from the wind-up and unwind machine 312 in the pass next to the last pass. Hence, when the nearly all of the coil is gone from the wind-up and unwind machine 312, the rotations of the rolling mill 301 and the wind-up and unwind machines 302, 312 are decelerated, the end portion of the strip having been secured to the reel of the wind-up and unwind machine 312 is released from the wind-up and unwind machine 312, and is stopped at the position of the shear 310. Then, immediately before the wind-up and unwind machine 302 is rotated in the direction indicated by an arrow *u*, the forward end of the strip is shorn by the shear 310, the wind-up and unwind machine 302 is rotated at low speed in the direction indicated by the arrow *u*, and the forward end of the strip stopped at the position of the shear 310 is led to the wind-up machine 311. After the forward end of the strip is led to the wind-up machine 311, said forward end of the strip is secured to the reel of the wind-up machine 311. After the forward end of the strip is secured to the wind-up machine 311, the wind-up and unwind machine 302 is rotated in the direction indicated by an arrow *u* and the wind-up machine 311 in the direction indicated by an arrow *y*, and as soon as the last rolling pass is commenced, a first piece of the coils of a small diameter for carry-out purpose.

As soon as the diameter of the coil formed in the wind-up machine 311 reaches the predetermined value, the shear 310 is actuated to shear the strip, and at the same time the wind-up machine 311 stops slowly. The end portion of the succeeding strip which is shorn is immediately led by a guide (not shown) to another wind-up machine (not shown), at the same time the rotations of the wind-up and unwind machine 302 and the rolling mill 301 are decelerated, and the end portion of the strip is stopped when it reaches said wind-up machine. Then, while the preparation for forming of a second coil of a small diameter for carry-out purpose is started, the coil of a small diameter 317 having been formed in the wind-up machine 311 is drawn out of a collapsible reel of the wind-up machine 311, carried out of the rolling line by a carry-out means 314 such as a coil car disposed adjacent to the wind-up machine 311.

As has been described above, according to this embodiment, there are provided an efficient reversible rolling method comprising of a step of forming a large coil on a rolling pass line from a plurality of coils of a small diameter after a strip to be rolled is carried into the inlet side of the reversible rolling mill in the forms of coils of a small diameter; a step of reversibly rolling said large coil in the reversible rolling mill; and a step of forming a plurality of coils of a small diamter which are formed from the strip having been rolled into the forms of easier transportability; and a reversible rolling equipment therefor. Additionally, according to the present invention, the coils carried into and carried out of the rolling equipment have the same size and weight as that of the ordinary coils and hence such an advantage is presented that part of the conventional rolling equipment as they are can be used. Furthermore, insertion and draw-out operations are not performed in the wind-up and unwind machine wherein the strip is subjected to tension during the rolling and hence rigidly constructed solid block type reels can be used in the wind-up and unwind machines for rolling. As the result, there are provided a rolling method and a rolling equipment exceedingly suitable for the rolling of stainless steels whose strips are required to be subjected to a strong tension during the rolling.

What is claimed is:

1. A coil handling apparatus comprising:

first means for unwinding a strip from a plurality of coiled strips of an ordinary size;

first joining means for joining the trailing end of a preceding strip of one of a plurality of coiled strips to the leading end of a next succeeding strip from another of the plurality of coiled strips, said first unwinding means and first joining means being arranged in a first processing line;

processing means arranged in a second processing line parallel to and spaced from said first processing line for processing the joined strip;

first winding means for winding the joined strip to form a larger diameter coiled strip up to at least ten times the size of an ordinary size coiled strip, said winding means being arranged in said first processing line;

second unwinding means for unwinding and feeding said large diameter coiled strip to said processing means without a looper means so as to provide semi-continuous feeding to the strip with minimal interruption times of the strip feeding, said second unwinding means being arranged in said second processing line;

each of said first winding means and said second unwinding means including coil support means for supporting a large diameter coil thereon and being alternately displaceable between said first and second processing lines for utilization in winding and unwinding; and means for rapidly and easily moving said coil support means of said first winding means having said large diameter coiled strip wound thereon in the axial direction thereof from said first processing line to said second processing line to enable unwinding of said strip therefrom and to provide for semi-continuous feeding of the strip and for moving said coil support means of said second unwinding means in the axial direction thereof from the second processing line to said first processing line to enable winding of the strip thereon.

2. A coil handling apparatus according to claim 1 comprising:

second winding means arranged in said second processing line for winding the strip processed and delivered from said processing means without a looper means to form a large diameter coiled strip up to at least ten times the size of an ordinary size coiled strip so as to enable semi-continuous delivery of the strip and to minimize the number of interruption times of the strip delivery;

third unwinding means arranged in a third processing line parallel to and spaced from said second processing line for unwinding a large diameter coiled strip;

shearing means arranged in said third processing line for receiving said strip from said third unwinding means and for shearing the strip into predetermined lengths sufficiently large to form individual coils of ordinary size;

third winding means arranged in said third processing line for winding the sheared length of strips to form individual coils of ordinary size;

each of said second winding means and said third unwinding means including coil support means for supporting a large diameter coil thereon and being alternately displaceable between said second and third processing lines for utilization in winding and unwinding; and means for rapidly and easily moving said coil support means of said second winding means having said large diameter coiled strip wound thereon in the axial direction thereof from said second processing line to said third processing line to enable unwinding of the strip therefrom and provide for semi-continuous delivery of the strip from the processing means and for moving said coil support means of said third unwinding means in the axial direction thereof from said third processing line to said second processing line to enable winding of the strip thereon.

3. A coil handling apparatus according to claim 2, wherein the large diameter coiled strip has a size and weight of approximately ten times that of an ordinary size coil and is difficult to transport.

4. A coil handling apparatus comprising:

processing means arranged in a first processing line for processing a strip;

winding means arranged in said first processing line for winding the strip processed by and delivered from said processing means without a looper means to form a large diameter coiled strip up to at least ten times the size of an ordinary size coiled strip so as to enable semi-continuous delivery of the strip and to minimize the number of times of interruption in strip delivery;

unwinding means arranged in a second processing line parallel to and spaced from said first processing line for unwinding a large diameter coiled strip;

each of said winding means and said unwinding means including coil support means for supporting a coiled strip of large diameter and being alternatively displaceable between said first and second processing lines for utilization in winding and unwinding;

means for rapidly and easily moving said coil support means of said winding means having a large diameter coiled strip wound thereon in the axial direction thereof from said first processing line to said second processing line to enable unwinding of the strip therefrom and to provide for semi-continuous delivery of the strip and for moving said coil support means of said unwinding means in the axial direction thereof from said second processing line to said first processing line to enable winding of the strip thereon;

shearing means arranged in said second processing line for receiving the strip from said unwinding means and for shearing the strip into predetermined lengths sufficiently large to form individual coils of ordinary size; and means arranged in said second processing line for winding the sheared lengths of strip to form individual coils of ordinary size.

5. A method for handling coiled strips comprising:

providing a first processing line;

unwinding a strip from a plurality of coiled strips of an ordinary size in the first processing line;

joining the trailing end of a preceding strip of one of a plurality of coiled strips to the leading end of a next succeeding strip from another of the plurality of coiled strips in the first processing line;

winding the joined strip on a first coil support means to form a large diameter coiled strip up to at least ten times the size of an ordinary size coiled strip in the first processing line;

providing a second processing line parallel to and spaced from the first processing line with processing means being arranged therein for processing the joined strip;

rapidly and easily moving the first coil support means having the large diameter coiled strip wound thereon in the axial direction thereof from the first processing line to the second processing line while moving a second coil support means positioned in the second processing line in the axial direction thereof from the second processing line to the first processing line to enable winding of the strip thereon;

unwinding and feeding the large diameter coiled strip in the second processing line to the processing means without looping the coiled strip so as to provide semi-continuous feeding of the strip to the processing means with minimized times of interruption in the strip feeding; and alternately displacing both said first and second coil support means between the first and second processing lines for utilization in winding and unwinding.

6. A method for handling coiled strips according to claim 5 comprising the steps of:

delivering the processed strip from the processing means for winding in the second processing line without looping the strip;

winding the delivered and processed strip to form a large diameter coiled strip up to at least ten times the size of an ordinary size coiled strip on a third coil support means arranged in the second processing line so as to enable semi-continuous delivery of the strip and to minimize the number of times of interruption of strip delivery;

providing a third processing line parallel to and spaced from the second processing line for unwinding the large diameter coiled strip therein;

rapidly and easily moving the third coil support means having the large diameter coiled strip wound thereon in the axial direction thereof from the second processing line to the third processing line while moving a fourth coil support means positioned in the third processing line in the axial direction thereof from the third processing line to the second processing line to enable winding of the strip processed and delivered from the processing means thereon;

unwinding and feeding the large diameter coiled strip from the coil support means arranged in the third processing line;

receiving the unwound strip in the third processing line and shearing the strip into predetermined lengths sufficiently large to form individual coils of ordinary size;

winding in the third processing line the sheared length of strips to form individual coils of ordinary size; and alternately displacing the third and fourth coil support means between the second and third processing lines for utilization in winding and unwinding.

7. A method for handling coiled strips according to claim 6, wherein the step of winding to form a large diameter coiled strip includes forming a coiled strip having a size and weight approximately ten times that of an ordinary size coiled strip processed by a rolling mill, the large diameter coiled strip being difficult to transport.

8. A method for handling coiled strips comprising:

providing a first processing line with a processing means for processing a strip arranged therein;

processing and delivering the strip without looping the strip for winding in the first processing line;

winding the strip delivered without looping thereof on a coil support means to form a large diameter coiled strip up to at least ten times the size of an ordinary size coiled strip so as to enable semi-continuous delivery of the strip and to minimize the number of times of interruption in strip delivery;

providing a second processing line parallel to and spaced from the first processing line for unwinding the large diameter coiled strip therein;

rapidly and easily moving the coil support means having the large diameter coiled strip wound thereon in the axial direction thereof from the first processing line to the second processing line while moving another coil support means positioned in the second processing line in the axial direction thereof from the second processing line to the first processing line to enable winding of the strip thereon;

unwinding the large diameter coiled strip in the second processing line;

receiving the unwound strip in the second processing line and shearing the strip into predetermined lengths sufficiently large to form individual coils of ordinary size;

winding the sheared lengths of strip in the second processing line to form individual coils of ordinary size; and alternately displacing the coil support means between the first and second processing lines for utilization in winding and unwinding.

* * * * *